US006993929B1

(12) United States Patent
Funk et al.

(10) Patent No.: US 6,993,929 B1
(45) Date of Patent: Feb. 7, 2006

(54) ICE-MAKING MACHINE WITH CONTOURED WATER CURTAIN

(75) Inventors: Howard G. Funk, Manitowoc, WI (US); Brad A. Blaha, Two Rivers, WI (US); Cary A. Stewart, Manitowoc, WI (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 0 days.

(21) Appl. No.: 10/913,011

(22) Filed: Aug. 5, 2004

(51) Int. Cl.
*F25C 1/12* (2006.01)

(52) U.S. Cl. ..... 62/347

(58) Field of Classification Search ..... 62/74, 62/347

See application file for complete search history.

(56) References Cited

U.S. PATENT DOCUMENTS

| | | | |
|---|---|---|---|
| 3,430,452 | A | 3/1969 | Dedricks et al. |
| 4,341,087 | A | 7/1982 | Van Steenburgh |
| 4,366,679 | A | 1/1983 | Van Steenburgh |
| 4,489,567 | A | 12/1984 | Kohl |
| 4,774,814 | A | 10/1988 | Yingst et al. |
| 4,986,088 | A | 1/1991 | Nelson |
| 5,031,417 | A | 7/1991 | Chang |
| 5,042,263 | A | 8/1991 | Day et al. |
| 5,924,301 | A | 7/1999 | Cook |
| 6,148,633 | A | 11/2000 | Yamada et al. |
| 6,705,090 | B2 | 3/2004 | Billman et al. |
| 6,907,744 | B2 * | 6/2005 | Miller et al. ..... 62/74 |

OTHER PUBLICATIONS

Publication, Grainger Catalog, 75th Anniversary, p. 3127.
Publication, Johnstone Supply, Wholesale Catalog #192, pp. 706 and 709.

* cited by examiner

*Primary Examiner*—William E. Tapolcai
(74) *Attorney, Agent, or Firm*—Brinks Hofer Gilson & Lione

(57) ABSTRACT

An ice machine includes a water curtain configured to minimize the flow of water into an ice bin underneath the ice machine. The water curtain is positioned adjacent to the front surface of an ice-forming mold and includes a body having a wide section and a narrow section. The wide section has hinge members therein so that the water curtain can swing away from the ice-forming mold during ice harvesting. The water curtain has a tongue at the bottom of the narrow section that is turned toward the ice-forming mold. Sidewalls of the water curtain extend toward the ice-forming mold. The sidewalls have indentations such that the narrow section is spaced inward from machine frame members adjacent to the sidewall when the water curtain is in a rest position.

27 Claims, 5 Drawing Sheets

ICE-MAKING MACHINE WITH CONTOURED WATER CURTAIN

TECHNICAL FIELD

The present invention relates to ice-making machines, and particularly to cube ice-making machines that have a vertical ice-forming mold and a water curtain to direct water cascading down the surface of the ice-forming mold back into a water sump.

BACKGROUND

A common design for a cube ice-making machine includes a vertical ice-forming mold. The mold has dividers that create individual pockets. When the pockets are sufficiently filled with ice, the control system for the machine switches into a harvest cycle. The ice cubes are released from the mold. The dividers may be sloped downward toward the open front so that the ice cubes slide out of the ice-forming mold under the influence of gravity, and into the ice collection bin.

The ice-making machine also includes a sump located beneath the ice-forming mold, a water distributor above the ice-forming mold, and a pump to transfer water from the sump up to the distributor. The water cascades down over the surface of the ice-forming mold. A part of the water freezes into the pockets and the rest runs off the surface of the ice-forming mold. A water curtain is placed adjacent to the ice-forming mold so that any splashing water is directed back into the sump. The bottom edge of the water curtain is bent to reach back under the ice-forming mold. This allows the front edge of the sump to be spaced behind the front of the ice-forming mold. With this design, the unfrozen water can return to the sump, but ice can fall straight down out of the ice-forming mold and into the collection bin.

The water curtain is typically suspended from pivots or hinges located near the top of the water curtain. The shape of the water curtain and location of the pivots are such that the center of gravity of the water curtain causes the sides of the water curtain to stay closed against the ice-forming mold frame while the machine is making ice. However, during the harvest cycle the water curtain can swing away as the ice is released from the ice-forming mold.

A common technique for shutting down the ice-making machines when the bin is full is to place a sensor, such as a magnetic reed switch, near the water curtain, and put a magnet on the water curtain. The reed switch can then determine whether the water curtain is closed. This reed switch has two uses. First, when the water curtain closes, the machine can automatically switch back into an ice-making mode from a harvesting mode. Second, if ice has built up in the bin such that the slab of ice being harvested does not fall all of the way past the bottom edge of the water curtain, the water curtain will remain open, and the reed switch will not close. If the water curtain stays open for a sufficient amount of time, the ice machine shuts down and the "bin full" condition starts.

During a freeze cycle, a thin bridge of ice forms over the dividers and between the individual cubes of ice. Most automatic ice-making machines allow for adjustment of the duration of the freeze cycle, which thus controls how thick this ice bridge becomes. A common control technique is to mount an ice thickness sensor so that as the ice bridge gets thicker, water running over the surface of it will contact a probe, directing the machine to automatically go into a harvest cycle. A thick ice bridge has the benefit that it helps in the harvest cycle, when water stops cascading over the front of the ice and the ice-forming mold is heated. A thick ice bridge allows the entire slab of interconnected ice cubes to be released at once. On the other hand, with a thin ice bridge, individual cubes have to each melt and drop out of their pockets, and adjoining cubes cannot help pull all of the ice out at once.

While thicker ice bridges have some benefits, there are also some drawbacks. Because ice is an insulator, the efficiency of the freezing operation decreases as the ice bridge builds, since the heat is commonly transferred out of the back of the ice-forming mold by serpentine refrigerant coils forming the evaporator section of a refrigeration system. Most importantly, many end users do not want thick ice bridges, because the slabs of ice cubes do not break into individual cubes as easily, and chunks of ice cubes frozen together are hard to dispense, scoop or fit into a cup.

Accurate control of ice bridging can be effective in providing properly sized ice cubes for the user. Care must be taken, however, to avoid the inadvertent freezing together of the ice cubes once they are delivered to the ice bin. Water going down the face of the ice-forming mold may fall into the ice bin rather than being directed by the bottom of the water curtain back into the sump. The leakage of water into the ice bin can cause the ice cubes in the ice bin to freeze together, or create wet ice in the ice bin. Also, for those machines that do not add water during the freeze cycle, and go into harvest when the water level drops to a predetermined point, the loss of water from the water recirculation system will result in less ice being made in each cycle. Accordingly, a need existed for an improved water curtain and ice machine that minimizes the leakage of water into the ice bin of an ice machine.

BRIEF SUMMARY

In one embodiment of the invention, a water curtain positioned adjacent to the front surface of an ice-forming mold includes a molded plastic body having a wide section and a narrow section. The wide section has hinge members therein and the narrow section has a tongue turned toward the ice-forming mold. Sidewalls of the water curtain extend toward the ice-forming mold. The sidewalls of the narrow section are spaced inwardly from machine frame members adjacent to the sidewalls when the water curtain is in a rest position.

In another embodiment of the invention, a water curtain is positioned adjacent to an ice forming-mold in an ice machine. The water curtain includes a generally rectangular body having opposing sidewalls and opposing upper and lower ends. The sidewalls have indentations in a lower portion and a raised section in the lower portion that is configured to rest against a mold frame of the ice-forming mold. A tongue extends from the lower end toward the ice-forming mold. A flange laterally extends from at least one of the indentations and terminates at a predetermined distance from the lower end.

In yet another embodiment of the invention, an ice machine includes a water sump and an ice-forming mold situated above the water sump, the ice-forming mold having a front face. A water curtain is positioned adjacent the front face of the ice-forming mold and configured to confine water cascading over the front face and to direct the water into the water sump. The water curtain is hinged so as to swing away from the ice-forming mold during ice harvest of ice cubes from the front face of the ice-forming mold. The water curtain includes opposing sidewalls adjacent to vertical frame members of the ice machine. The opposing sidewalls include indentations in a lower portion of the ice curtain that space the lower portion inwardly from the vertical frame members.

In still another embodiment of the invention, an ice machine having a water curtain configured to minimize the flow of water into an ice bin underneath the ice machine includes a water sump and an ice-forming mold supported by a mold frame and positioned above the water sump, the ice-forming mold having a front face. A water curtain is positioned adjacent the front face of the ice-forming mold and configured to direct water cascading over the front face into the water sump. The water curtain is hinged so as to swing away from the ice-forming mold during an ice harvest of ice cubes from the front face of the ice-forming mold. Sidewalls on the water curtain extend toward the ice-forming mold, wherein the sidewalls have indentations in a lower portion of the water curtain that narrow the width of the water curtain. A tongue extends from a bottom edge of the water curtain toward the ice-forming mold and a flange laterally extends from at least one indentation and terminates on the sidewall at a point displaced away from the tongue.

In a further embodiment of the invention, a water curtain for use in an ice machine includes a body having a length and a width and an inner surface and an outer surface. A central portion has a first width and narrow portions at an upper end and a lower end of the body have a second width, where the second width is less than the first width. Sidewalls upstanding from the inner surface are tapered such that their height above the inner surface decreases in a direction from the upper end toward the lower end of the body. Hinge pins laterally extend from the sidewalls in the narrow portion at the upper end and a tongue depends from the narrow portion at the lower end and is continuous with the sidewalls.

DETAILED DESCRIPTION OF THE DRAWING AND PREFERRED EMBODIMENTS OF THE INVENTION

The present invention is an improvement of the water curtain described and illustrated in co-pending, commonly-assigned patent application Ser. No. 10/389,285, filed Mar. 14, 2003, which is incorporated by reference herein. The water curtain illustrated in the '285 application includes ribs that are formed on an inside surface of the water curtain adjacent to an ice-forming mold in an ice making machine. The ribs on the inside surface of the water curtain are configured such that a slab of ice cubes released from the ice-forming mold during a harvest cycle contacts the inside surface and forces the curtain to open. The position of the ribs and the distance that the ribs extend toward the ice-forming mold determines the extent to which the water curtain opens.

Figure 1:
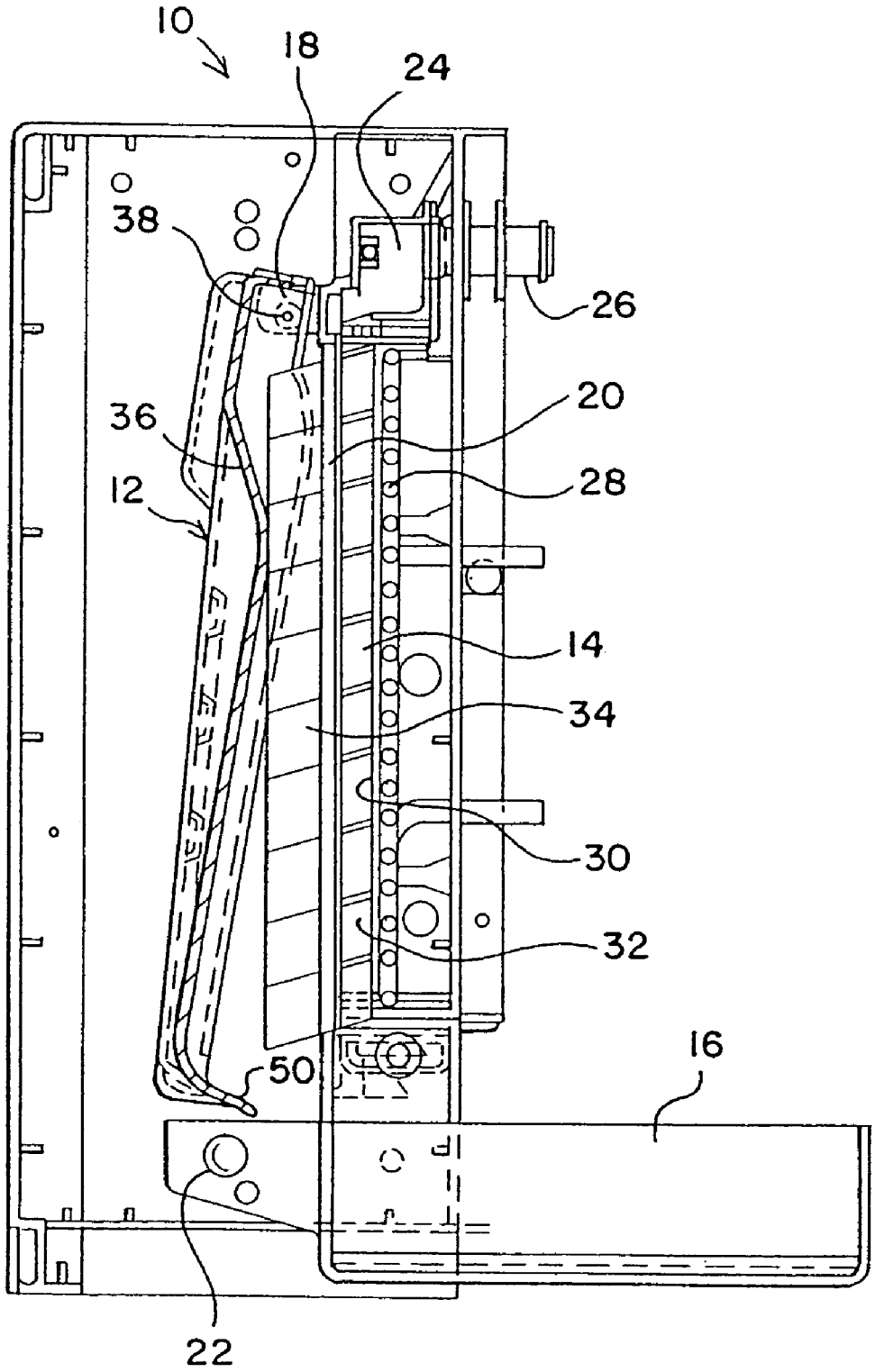
FIG. 1 is a cross-sectional view of an ice-making machine incorporating the present invention showing a slab of ice being released and a water curtain positioned in front of an ice-forming mold and positioned over a water sump.
Figure 3:
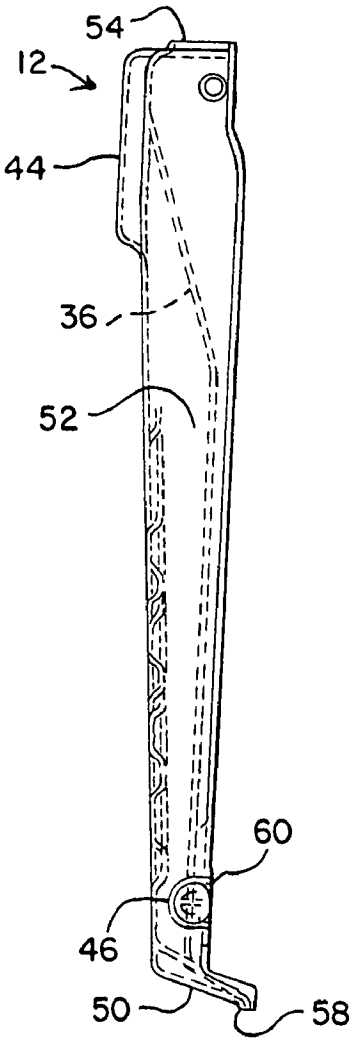
FIG. 3 is a side elevation view illustrating one side of the water curtain of FIG. 2.
Figure 2:
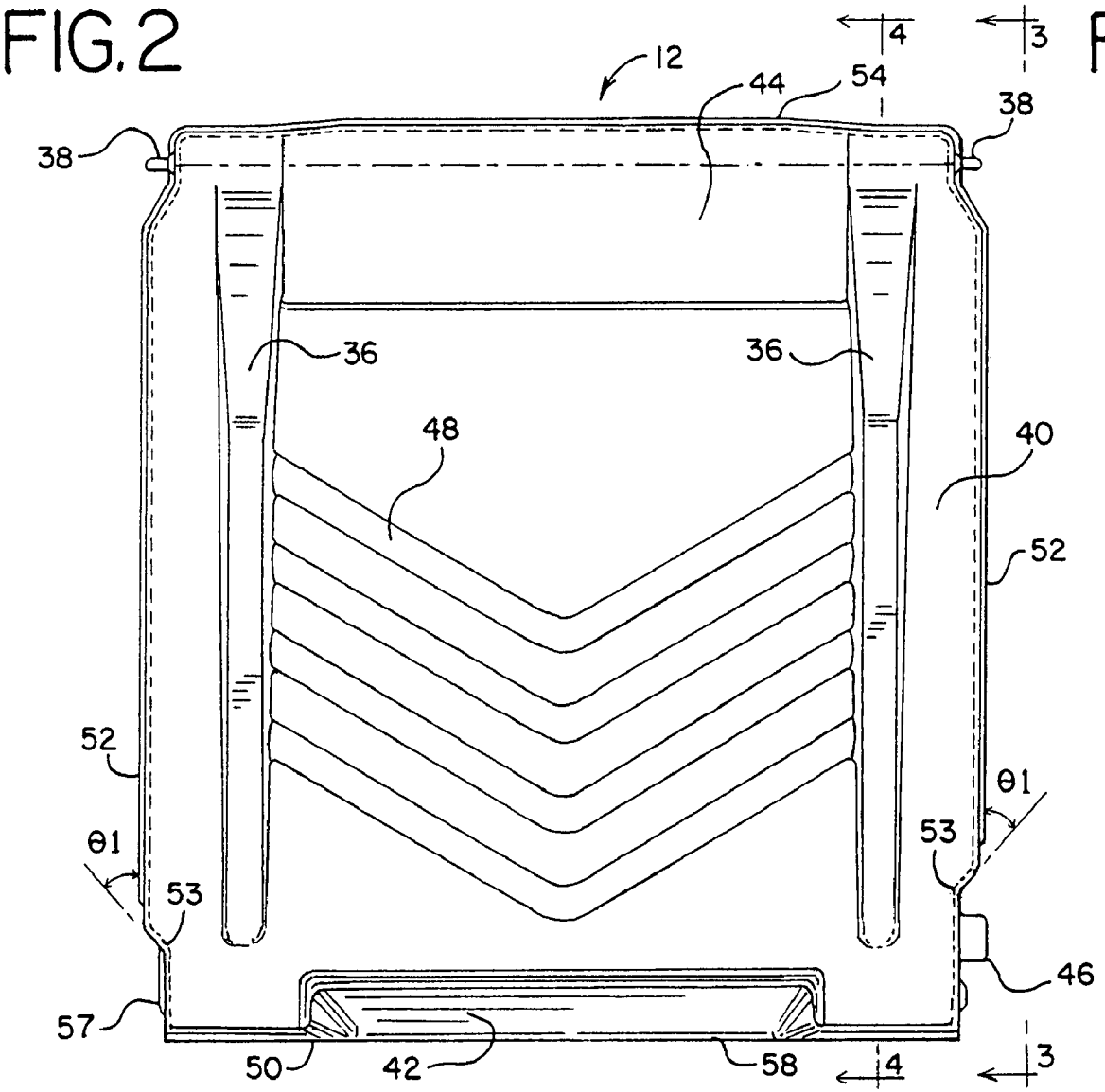
FIG. 2 is a front elevational view of a water curtain in accordance with the invention.
Figure 4:
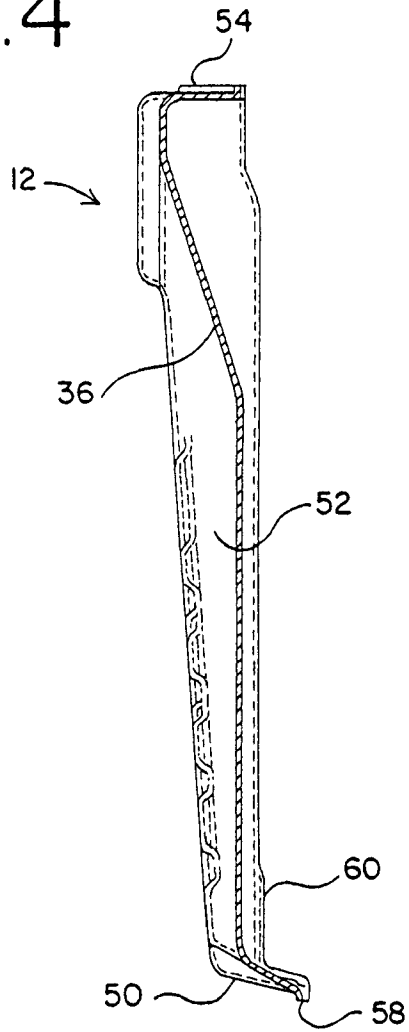
FIG. 4 is a cross-sectional view illustrating taken along section line 4—4 of the water curtain illustrated in FIG. 2.

A cross-sectional view of an ice machine 10 having a water curtain 12 mounted therein and configured in accordance with an embodiment of the invention is illustrated in FIG. 1. An elevation view and left and right side views of water curtain 12 are illustrated in FIGS. 2, 3, and 4, respectively. As shown in FIG. 1, in ice machine 10, an ice-forming mold 14 is positioned over a sump 16 and water curtain 12 is mounted in front of ice-forming mold 14. Ice-forming mold 14 is mounted within ice machine 10 by mold frame 20 (only one frame member is visible in FIG. 1). A hinge mechanism that includes hinge flanges 18 attached to a water distributor 24 rotatably positions water curtain 12 in front of ice-forming mold 14. Sump 16 is secured within ice machine 10 by mounting tabs 22 on both sides of the ice machine, although only one of the mounting tabs is seen in FIG. 1. Several features of an ice machine having components arranged in a preferred configuration is disclosed in commonly-assigned, co-pending U.S. patent application having Ser. No. 10/913,787 entitled "Ice Machine Including A Condensate Collection Unit, An Evaporator Attachment Assembly, and Removable Sump," filed on even date herewith, the disclosure of which is incorporated by reference herein. Also, a water distributor having several preferred design features is disclosed in commonly-assigned, co-pending U.S. patent application having Ser. No. 11/192,693 entitled "An Ice Machine And Ice-Making Assembly Including A Water Distributor," filed on even date herewith, the disclosure of which is incorporated by reference herein.

Water distributor 24 distributes water fed through inlet pipe 26 such that the water cascades down over ice-forming mold 14. Cooling coils 28 chill an adjacent metal plate 30 and ice cubes form within sections 32 arrayed along metal plate 30. As will subsequently be described, water curtain 12 is configured to confine the water flowing down ice-forming mold 14 within the space between the water curtain and the ice-forming mold and to return the water to sump 16. Accordingly, water is retained in the water recirculation system of the ice machine and is prevented from leaking into the ice bin (not shown) located directly below ice-forming mold 14. As described above, any water leakage into the ice bin is problematic because the water tends to refreeze and cause the ice cubes to stick together in the ice bin. In extreme situations, large blocks of ice form in the ice bin, which reduces the number of individual ice cubes available to a consumer. Further, improved sanitation is obtained by minimizing the escape of water from the water recirculation system in the ice machine.

During a harvest cycle, metal plate 30 and sections 32 are heated, which causes a slab 34 of interconnected ice cubes to be discharged from ice-forming mold 14. Slab 34 contacts ribs 36, which forces water curtain 12 to swing open on hinge pins 38. Ribs 36 are configured such that as slab 34 contacts the ribs, the slab forces water curtain 12 to open to a point where the bottom of the water curtain will not contact the bottom of the falling slab of ice cubes. The position of hinge pins 38 forming the hinge axis and the configuration of the inside surface of water curtain 12 cooperate to cause the water curtain to open so that the bottom edge of the water curtain is out of the way and the slab of ice can pass between sump 16 and the bottom edge of the water curtain.

As illustrated in the front elevation view of FIG. 2, water curtain 12 is a generally rectangular body having a wide section 40 and a narrow section 42. Preferably, water curtain 12 is formed by an injection molding or a vacuum molding process. Holes are formed in the sidewalls of upper section 44 that accommodate hinge pins 38. Hinge pins 38 fit into holes formed in hinge flanges 18 and rotatably suspend water curtain 12 in front of ice-forming mold 14. Narrow section 42 includes a magnet housing 46 that contains a magnet (not shown). The magnet in magnet housing 46 is sensed by a magnetic reed switch (not shown) and is used by the ice-machine to detect when water curtain 12 opens and closes. Magnet housing 46 includes a cover 47 (shown in FIGS. 7 and 8) that allows the magnet to be inserted into magnet housing 46 before being sealed.

Ribs 36 are illustrated in silhouette outline on an inside surface of water curtain 12. Ribs 36 extend vertically from upper section 44 to narrow section 42. A group of V-shaped chevrons 48 extend between ribs 36 on the inside surface of water curtain 12. V-shaped chevrons extend between ribs 36 so that the ends of the chevrons tie into the inside wall of ribs 36. V-shaped chevrons 48 provide rigidity to water curtain 12. Narrow section 42 of water curtain 12 includes a tongue 50 that extends from narrow section 42 and is folded toward ice-forming mold 14.

In accordance with an embodiment of invention, ribs 36 are truncated so that they do not extend all of the way to tongue 50. By terminating ribs 36 at a point above and spaced apart from tongue 50, water flowing down the surface of the ribs does not splash against the inside surface of the tongue and get redirected to the edges of the water curtain. When the ribs extend all of the way to the tongue, the water that is redirected to the edges of the water curtain can splash onto the frame and track into the ice bin. In contrast, when ribs 36 terminate a distance above tongue 50, water flows off the ribs onto the inside surface of the water curtain and onto the inner surface of the tongue. The water then flows directly into the sump.

As illustrated in FIGS. 3 and 4, water curtain 12 has sidewalls 52 that are integrally formed with tongue 50 and with a top edge 54. Sidewalls 52 join top edge 54 and tongue 50 so as to bound the inner surface of water curtain 12 and form a bowl-shaped surface that faces ice-forming mold 14. As further illustrated in FIGS. 3 and 4, the depth of the sidewalls 52 tapers such that the sidewalls gradually decrease in width from top edge 54 to tongue 50. Accordingly, the volume of space partially enclosed by the bowl-shaped inner surface of water curtain 12 is greater at the upper end then at the lower end.

Figure 5:
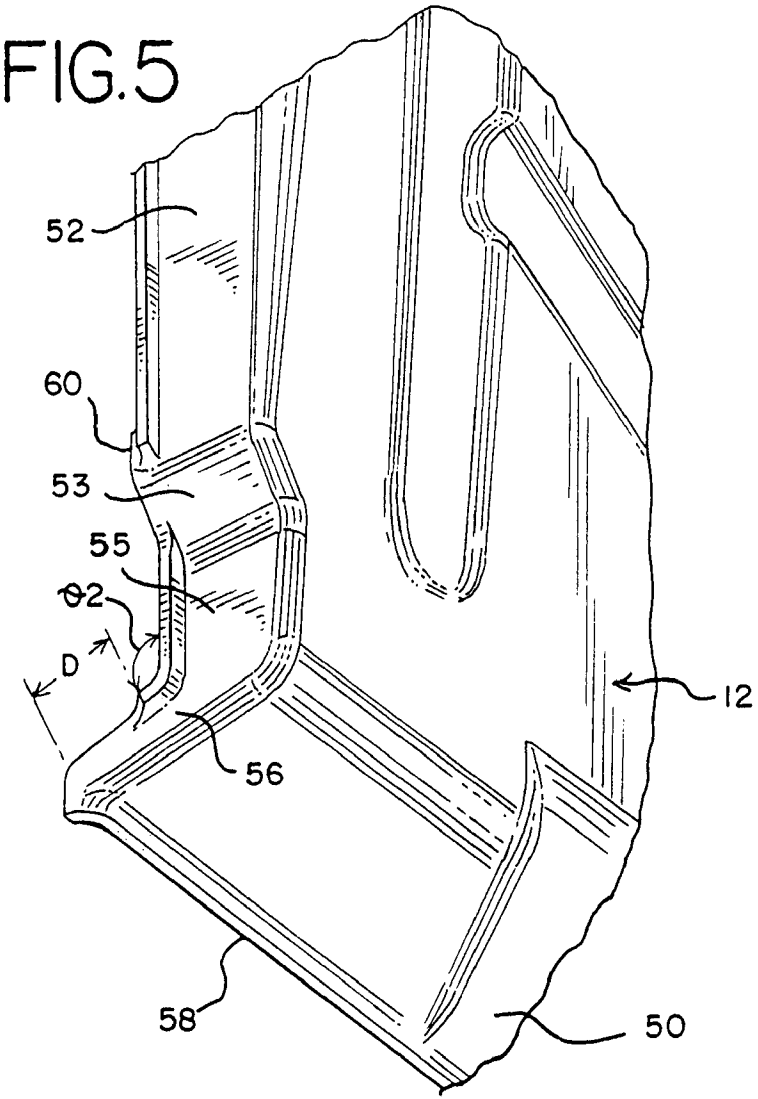
FIG. 5 is perspective view of a corner portion of the water curtain illustrated in FIG. 2.

As shown in FIG. 2, narrow section 42 is formed by indentations 53 in sidewalls 52. Indentations 53 curve inward and reduce the overall width of water curtain 12 at bottom end. FIG. 5 is a partial perspective view of water curtain 12 showing the side of water curtain 12 opposite from magnet housing 46. Sidewalls 52 are contoured to form a continuous surface 55 that first bends toward the center of the water curtain at a first angle θ1 (shown in FIG. 2), then bends at a second angle θ2 (shown in FIG. 5) to form a side edge 56 of tongue 50. In the illustrated embodiment, second angle θ2 is substantially orthogonal to the first angle θ1. In a one embodiment of the invention, first angle θ1 is preferably about 39° to about 41° and, more preferably, about 40°, and second angle θ2 is preferably about 104° to about 106° and, more preferably about 105°. As shown in FIG. 2, the sidewall that contains magnetic housing 46 is contoured in a similar way to that shown in FIG. 5, but indentation 53 is displaced more toward top edge 54 to allow for magnet housing 46.

Water curtain 12 includes a flange 57 that extends from folded edge 52 and a flange 58 that extends from tongue 50. As illustrated in FIG. 5, flange 57 extends laterally from folded side edge 52 at narrow section 42 of water curtain 12. Flange 57 terminates on side edge 56 at a distance D above the bottom edge of tongue 50. Flange 57 functions to prevent water curtain 12 from becoming impinged against the frame of the ice-forming mold when water curtain 12 swings back into its rest position following an ice harvest cycle. Flange 57 is terminated at distance D above the bottom edge of tongue 50 to prevent water from tracking along the edge of water curtain 12 and onto the frame of ice-forming mold 14. In one embodiment, distance D is preferably about 0.92 inches to about 0.98 inches and, more preferably, about 0.95 inches.

Flange 58 laterally extends from the bottom edge of tongue 58 and forms a continuous surface with side edge 56. Flange 58 functions to prevent water from wicking up the outer surface of water curtain 12 as water is directed over ice-forming mold 14 during a freeze cycle. When water curtain 12 is in a rest position, flange 58 is in a substantially horizontal position extending below tongue 50. As water cascades down the inner surface of water curtain 12, water drips off the edge of flange 58 into sump 16 and does not adhere to the outside surface of tongue 50.

In addition to flanges 57 and 58, water curtain 12 also includes a raised section 60. As will subsequently be described, raised section 60 rests against the frame of ice-forming mold 14 and stands the remaining portions of sidewalls 52 away from the frame.

Figure 6:
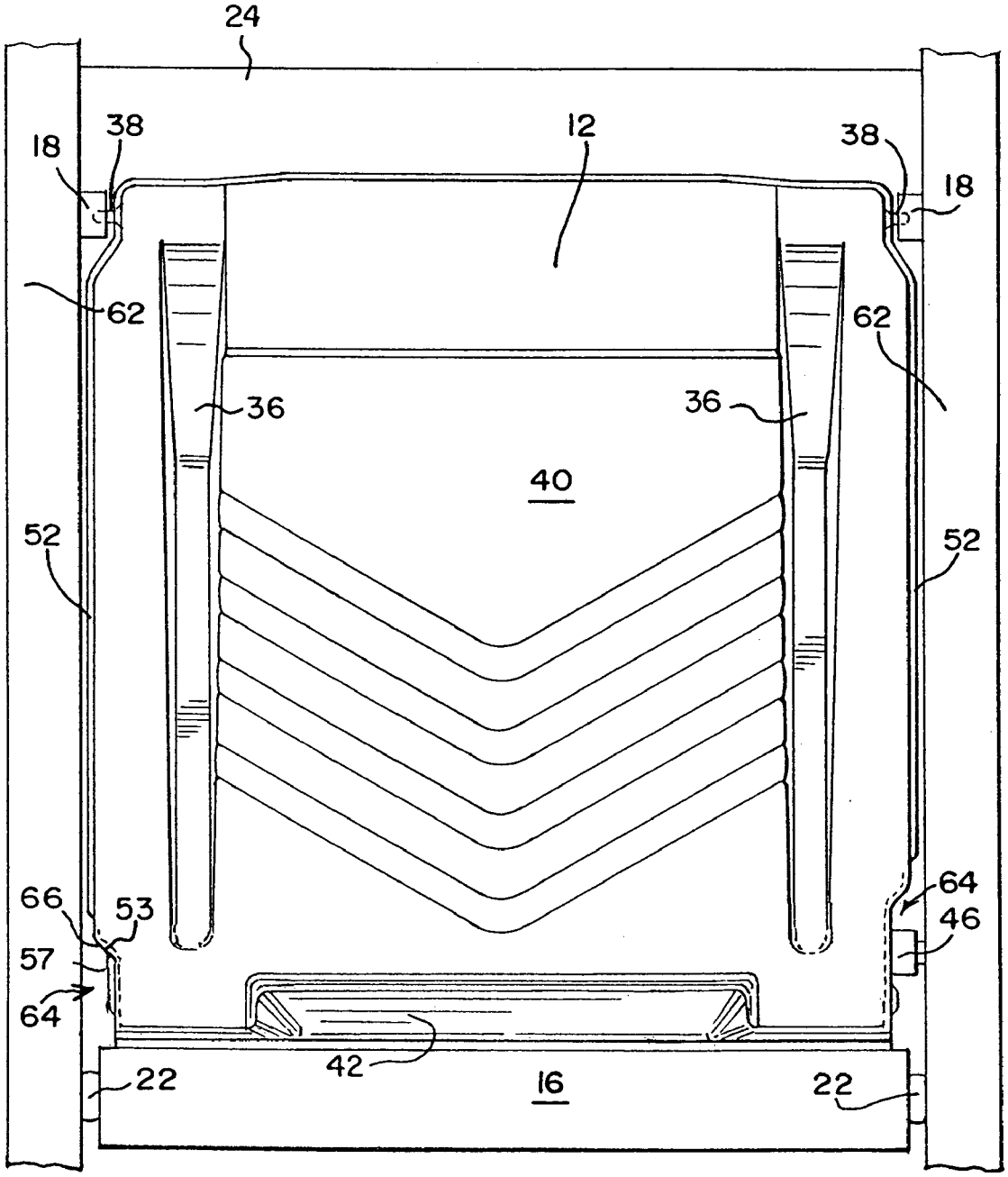
FIG. 6 is a partial front elevation view of the ice machine illustrated in FIG. 1 having the water curtain of FIG. 2 positioned within a frame of the ice machine.

A front view of water curtain 12 positioned in front of ice-forming mold 14 is illustrated in FIG. 6. Machine frame members 62 are positioned adjacent to sidewalls 52 of water curtain 12 and extend outwardly at right angles from ice-forming mold 14 and water distributor 24. Hinge pins 38 insert into hinge flanges 18 to support water curtain 12 above sump 16. The indentations 53 in sidewalls 52 create spaces 64 between frame members 62 and narrow section 42 of water curtain 12. Spaces 64 function to prevent water that travels along sidewalls 52 from transferring by capillary action to the edges of frame members 62. By providing spaces 64, water that flows down ice-forming mold 14 and splashes into the inner surface of water curtain 12 is preventing from escaping along frame members 62 and dripping into the ice compartment. Accordingly, the various contoured features of water curtain 12 cooperate to minimize the loss of water from around the edges of water curtain 12 and tracking onto frame members 62.

Flange 57 protrudes laterally from sidewalls 52 by a distance that is sufficient to overlap onto a portion of a face surface 66 of mold frame 20. When water curtain 12 opens to allow a slab of ice to drop into the ice bin, the curtain falls back to its rest position once the slab drops below tongue 50. Under the influence of gravity, the weight of water curtain 12 swinging on hinge pins 38 can create a moment force about the hinge axis. In the absence of flange 57, water curtain 12 can close with sufficient force to cause the edge of the water curtain to become impinged against an inside surface of mold frame 20. Flange 57 prevents the impingement by providing a stop against face surface 66 of mold frame 20.

Figure 7:
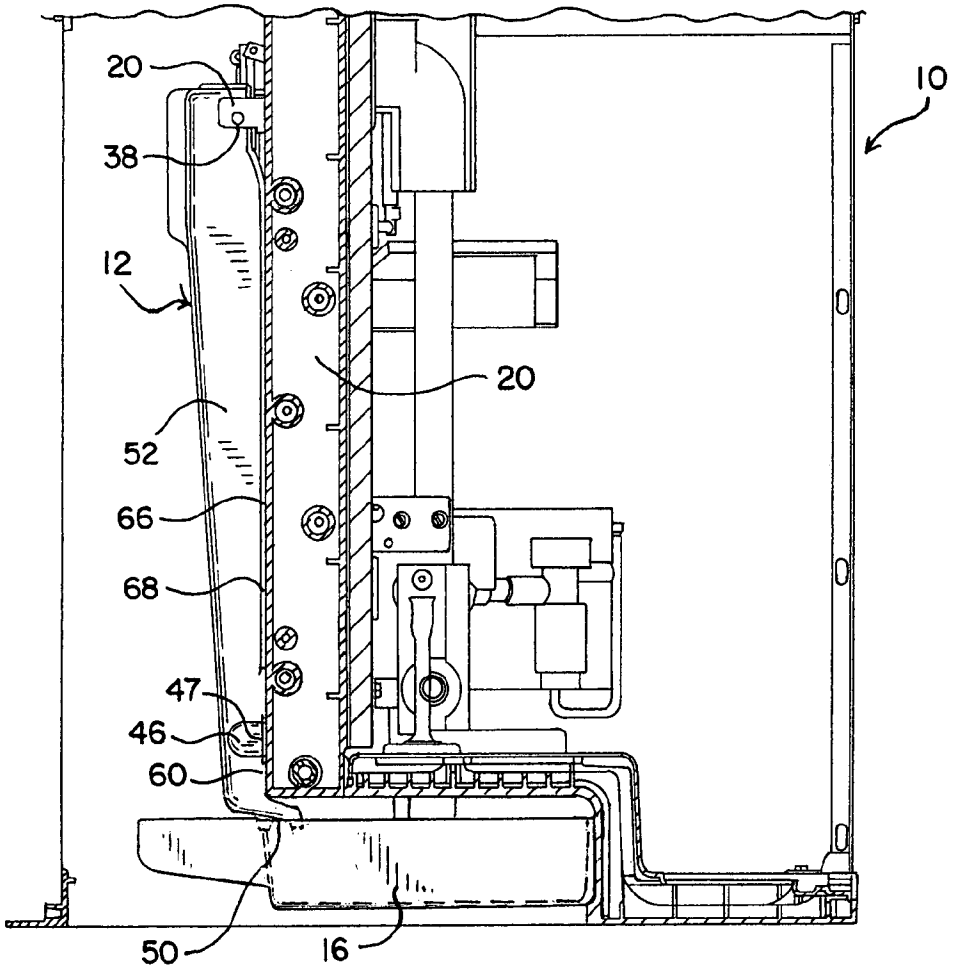
FIG. 7 is a partial cross-sectional view of an ice-making machine showing the water curtain of FIG. 2 positioned next to a frame and over a water sump.

A partial cross-sectional view of a portion of an ice machine 10 is illustrated in FIG. 7. Water curtain 12 hangs from hinge flanges 18 in a rest position against mold frame

20. In the rest position, tongue 50 extends below ice-forming mold 14 and into sump 16. In the rest position, water cascading down the front of ice-forming mold 14 will be directed by water curtain 12 into sump 16 rather than into the ice bin underneath ice machine 10. Raised section 60 of water curtain 12 contacts face surface 66 of mold frame 20 and creates a gap 68 between sidewalls 52 and face surface 66.

Figure 8:
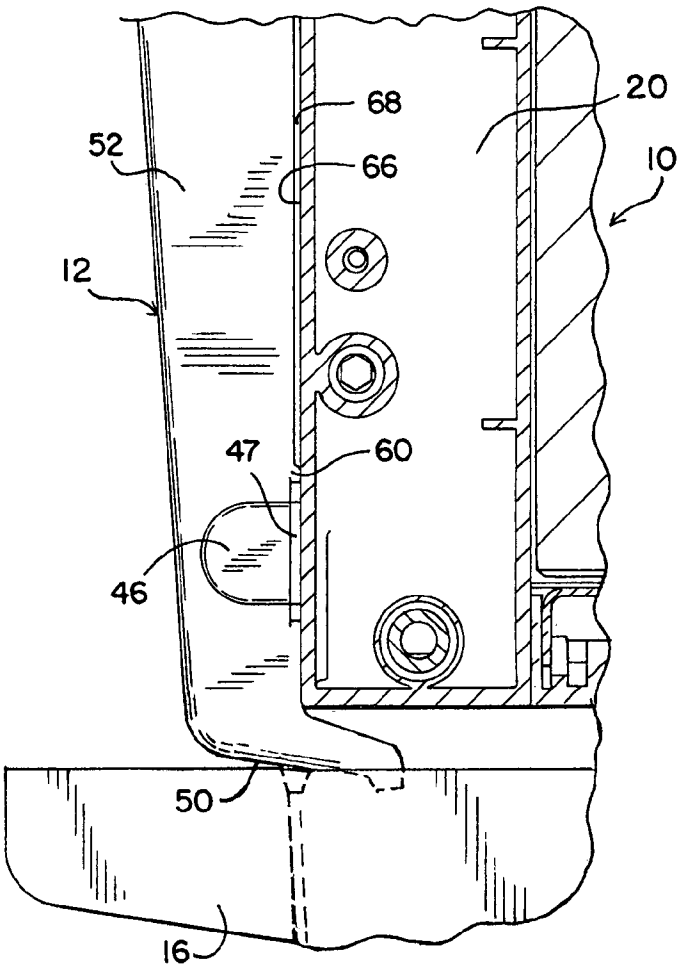
FIG. 8 is an enlarged view of a portion of the ice-making machine illustrated in FIG. 7.

A magnified portion of the assembly of FIG. 7 is shown in FIG. 8. Gap 68 has its largest dimension in proximity to raised section 60 and gradually decreases in width as it approaches the top of water curtain 12. Gap 68 is sufficiently large to prevent the water flowing down the inside surface of folded edges 52 from flowing onto face surface 66 of mold frame 20. Accordingly, raised section 60 is of sufficient width to prevent water tracking through capillary action between water curtain 12 and surfaces of mold frame 20.

The feature of water curtain 12 described above cooperate to minimize the leakage of water out of the water recirculation system and into the ice bin. The truncated ribs, indentations in the folded side edges and flanges reduce water tracking to the frame members of the ice machine. By keeping water leakage into the ice bin at a minimum, ice clumping, wet ice, and a false low water level indication can be avoided.

It will be appreciated that the addition of some other process steps, materials or components not specifically included will have an adverse impact on the present invention. The best mode of the invention may therefore exclude process steps, materials or components other than those listed above for inclusion or use in the invention. However, the described embodiments are to be considered in all respects only as illustrative and not restrictive, and the scope of the invention is, therefore, indicated by the appended claims rather than by the foregoing description. All changes which come within the meaning and range of equivalency of the claims are to be embraced within their scope.

What is claimed is:

1. A water curtain positioned adjacent to the front surface of an ice-forming mold, the water curtain comprising:

(a) a molded plastic body having a wide section and a narrow section, the wide section having hinge members therein and the narrow section having a tongue turned toward the ice-forming mold; and (b) sidewalls extending toward the ice-forming mold, wherein the sidewalls of the narrow section are spaced inwardly from machine frame members adjacent to the sidewalls when the water curtain is in a rest position.

2. The water curtain of claim 1 further comprising at least one vertical rib on an inside surface of the molded plastic body, the at least one vertical rib having a sufficient height with respect to the front face of the ice-forming mold so that ice from the ice-forming mold will contact the rib to force the water curtain out away from the ice-forming mold, wherein the vertical ribs terminate at a point above and spaced apart from the bottom edge.

3. The water curtain of claim 1 wherein the tongue includes a flange extending along a bottom edge thereof.

4. The water curtain of claim 1 further comprising a flange laterally extending from at least one of the sidewalls, the flange tapering into the sidewall at a position above the bottom edge.

5. The water curtain of claim 1 further comprising:

(a) a mold frame having members adjacent to the ice-forming mold, the members having a face surface; and (b) a raised section in a lower portion of the sidewalls configured to rest against the face surface of the mold frame members and to stand remaining portions of the sidewalls away from the face surface.

6. A water curtain positioned adjacent to an ice forming-mold in an ice machine, the water curtain comprising:

(a) a generally rectangular body having opposing sidewalls and opposing upper and lower ends;

(b) indentations in a lower portion of the opposing sidewalls and a raised section in the lower portion configured to rest against a mold frame of the ice-forming mold;

(c) a tongue extending from the lower end toward the ice-forming mold; and (d) a flange laterally extending from at least one of the indentations, wherein the flange terminates at a predetermined distance from the lower end.

7. The water curtain of claim 6 further comprising a hinge positioned adjacent the upper end, such that the water curtain can swing away from the ice-forming mold during harvesting ice cubes from the ice-forming mold.

8. The water curtain of claim 7 wherein the flange is configured to prevent the water curtain from becoming impinged against an inner surface of the mold frame when the water curtain swings back toward the ice-forming mold during the harvesting of ice cubes.

9. The water curtain of claim 6 further comprising a magnet housing molded into one of the indentations.

10. The water curtain of claim 6 further comprising at least one vertical rib on an inside surface of the body, the at least one vertical rib having a sufficient height with respect to a front face of the ice-forming mold so that a slab of ice from the ice-forming mold will contact the at least one vertical rib to force the water curtain out away from the ice-forming mold to a position where the tongue is not underneath the slab of ice during the ice harvest, wherein the at least one vertical rib terminates at a point above and spaced apart from the tongue.

11. An ice machine comprising:

(a) a water sump;

(b) an ice-forming mold situated above the water sump, the ice-forming mold having a front face;

(c) a water curtain positioned adjacent the front face of the ice-forming mold and configured to confine water cascading over the front face and direct the water into the water sump, the water curtain being hinged so as to swing away from the ice-forming mold during ice harvest of ice cubes from the front face of the ice-forming mold, wherein the water curtain includes opposing sidewalls adjacent to vertical frame members of the ice machine, and wherein the opposing sidewalls include indentations in a lower portion of the ice curtain that space the lower portion inwardly from the vertical frame members.

12. The ice machine of claim 11 further comprising;

(a) a tongue extending from a bottom edge of the water curtain and bent toward the ice-forming mold; and (b) at least one vertical rib on an inside surface of the water curtain, the at least one vertical rib having a sufficient height with respect to the front face of the ice-forming mold so that a slab of ice from the ice-forming mold will contact the at least one vertical rib to force the water curtain out away from the ice-forming mold to a position where the tongue is not underneath the slab of ice during the ice harvest, wherein the at least one vertical rib terminates at a point above and spaced apart from the tongue.

13. The ice machine of claim 11 wherein the water curtain further comprises an inner surface adjacent to the front face of the ice-forming mold and an outer surface opposite the inner surface, wherein the opposing sidewalls extend toward the ice-forming mold so as to minimize water tracking to the exterior surface.

14. The ice machine of claim 11 wherein a depth of the opposing sidewalls decreases in a direction from an upper end to a lower end, and wherein the water curtain further comprises a raised section in the opposing sidewalls adjacent the lower end that is configured to rest against a face surface of a mold frame, such that remaining portions of the opposing sidewalls are spaced apart from the face surface of the mold frame.

15. An ice machine having a water curtain configured to minimize the flow of water into an ice bin underneath the ice machine, the ice machine comprising:

(a) a water sump;

(b) an ice-forming mold supported by a mold frame and positioned above the water sump, the ice-forming mold having a front face;

(c) a water curtain positioned adjacent the front face of the ice-forming mold and configured to direct water cascading over the front face into the water sump, the water curtain being hinged so as to swing away from the ice-forming mold during an ice harvest of ice cubes from the front face of the ice-forming mold;

(d) sidewalls on the water curtain extending toward the ice-forming mold, wherein the sidewalls have indentations in a lower portion of the water curtain that narrow the width of the water curtain;

(e) a tongue extending from a bottom edge of the water curtain toward the ice-forming mold; and (f) a flange laterally extending from at least one indentation and terminating on the sidewall at a point displaced away from the tongue.

16. The ice machine of claim 15 wherein the flange is configured to prevent the water curtain from becoming impinged against a frame for the ice-forming mold when the water curtain swings back toward the ice-forming mold after the ice harvest.

17. The ice machine of claim 15 wherein the ice-forming mold is mounted within a frame, and wherein the indentations of the water curtain are configured to minimize water splashing from the water curtain onto the frame during the beginning of a freeze cycle.

18. The ice machine of claim 15 wherein the water curtain comprises an inner surface adjacent to the ice-forming mold and an outer surface opposite from the inner surface, and wherein the water curtain further comprises at least one rib in the inner surface, the at least one rib having a sufficient height with respect to the inner surface so that the ice will contact the rib to force the water curtain out away from the ice-forming mold such that the tongue is not underneath the ice during the ice harvest.

19. The ice machine of claim 18 wherein the at least one rib is vertically oriented on the inner surface and wherein the at least one rib terminates at a point above and spaced apart from the tongue.

20. The ice machine of claim 15 wherein the tongue includes a flange that is configured to minimize water wicking up a back face of the water curtain.

21. The ice machine of claim 15 wherein the sidewalls are tapered from a top edge toward the bottom edge of the water curtain, and wherein the sidewalls included a raised section that rests against a face surface of the mold frame and that spaces remaining portions of the sidewalls away from the face surface.

22. The ice machine of claim 15 wherein the water curtain comprises a molded plastic body and a molded magnet housing located in one of the sidewalls of the water curtain, such that the magnet housing is positioned adjacent to a sensor located in a machine frame when the water curtain is in a rest position.

23. The ice machine of claim 15 wherein the water curtain further comprises a cover positioned adjacent to the molded housing that allows a magnet to be inserted into molded housing before sealing.

24. A water curtain for use in an ice machine, the water curtain comprising:

(a) a body having a length and a width and an inner surface and an outer surface;

(b) a central portion having a first width;

(c) narrow portions at an upper end and a lower end of the body, the narrow portions having a second width, wherein the second width is less than the first width;

(d) sidewalls upstanding from the inner surface, wherein the sidewalls are tapered such that their height above the inner surface decreases in a direction from the upper end toward the lower end of the body;

(e) hinge pins laterally extending from the sidewalls in the narrow portion at the upper end; and (f) a tongue depending from the narrow portion at the lower end and continuous with the sidewalls.

25. The water curtain of claim 24 further comprising at least one rib on the inside surface of the body extending from the upper end toward the lower end and terminating at a point on the inside surface above and spaced apart from the tongue.

26. The water curtain of claim 24 further comprising a flange laterally extending from at least one sidewall in the narrow portion at the lower end of the body wherein the flange terminates on the sidewall at a predetermined distance from the tongue.

27. The water curtain of claim 24 wherein the tongue includes a flange extending along a bottom edge thereof.

* * * * *